US007219964B2

(12) United States Patent
Berning et al.

(10) Patent No.: US 7,219,964 B2
(45) Date of Patent: May 22, 2007

(54) MILLING MACHINE AS WELL AS METHOD FOR WORKING GROUND SURFACES

(75) Inventors: Christian Berning, Zuelpich (DE); Herbert Lange, Overath (DE); Dieter Simons, Buchholz (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 11/057,838

(22) Filed: Feb. 15, 2005

(65) Prior Publication Data

US 2005/0179309 A1 Aug. 18, 2005

(30) Foreign Application Priority Data

Feb. 16, 2004 (DE) ..... 10 2004 007 716

(51) Int. Cl.
*E01C 23/088* (2006.01)

(52) U.S. Cl. ..... 299/64; 55/385.5

(58) Field of Classification Search ..... 299/12, 299/39.1, 39.2, 39.4, 64; 55/385.5
See application file for complete search history.

(56) References Cited

U.S. PATENT DOCUMENTS 2,100,178 A * 11/1937 White ..... 299/68
RE24,004 E * 5/1955 Howard ..... 299/57
6,733,086 B1 * 5/2004 McSharry et al. ..... 299/64

FOREIGN PATENT DOCUMENTS

DE 102 23 819 A1 5/2002
EP 0 971 075 A1 7/1999

* cited by examiner

*Primary Examiner*—Sunil Singh
(74) *Attorney, Agent, or Firm*—Diller, Ramik & Wight

(57) ABSTRACT

At a milling machine to work ground surfaces, with a machine frame, a milling drum supported at the machine frame, at least one transport device arranged at the machine frame which accepts the milled material from the milling drum, as well as with a suction device for the air polluted with dusts and vapors, whereby the milled material on the at least one transport device is enclosed by a channel, the suction device is connected to a rear channel section of the channel in the direction of the material transport and sucks off the air polluted during milling at the milling drum and in the rear channel section essentially in the direction of the material transport, it is provided that the suction device consists of a suction ventilator, a separator device for solids and a suction channel which is connected to the rear channel section, that the suction ventilator is arranged downstream of the separator device, and that the suction device disposes of the separated solids onto the transport device in a forward channel section in the direction of the material transport or into a collecting device, and the suction ventilator blows off the cleaned air into the environment.

7 Claims, 6 Drawing Sheets

MILLING MACHINE AS WELL AS METHOD FOR WORKING GROUND SURFACES

BACKGROUND OF THE INVENTION

The invention concerns a milling machine to work ground surfaces, in particular pavements, as well as a process to dispose of dusts and vapors developing during the milling operation on a milling machine.

Such milling machines are self-propelled and are also referred to as road milling machines.

A front-loading milling machine in accordance is known from DE 102 23 819 A1. The known road milling machines show a self-propelled chassis with a travel drive unit consisting of several wheel units or several crawler track units. The chassis carries a machine frame in which a milling drum is supported transversely to the direction of travel. To achieve the completest possible removal of the milled material, the milling drum is generally enclosed by a housing, the wall of which pointing in the direction of travel is designed as a covering blade with an opening for the milled material. The material processed by the milling drum is accepted by a first transport conveyor, which transfers the processed material at the forward end of the milling machine onto a discharge conveyor, which can be tilted and slewed laterally for transport onto a loading space of a truck.

It is already known from DE 102 23 819 A1 and EP 0 971 075 A1 to provide the transport conveyors of a road milling machine with a hood in order to suck off and dispose of the dust developing at the milling drum and beneath the hood of the transport conveyors by means of a ventilator and, where appropriate, a cyclone.

In EP 0 971 075 A1, it is proposed to suck off the dust against the direction of the material transport and to dispose of the dust by means of a ventilator and a cyclone at the rear end of the road milling machine. Here, it is of disadvantage that an extraction by suction at the transport conveyors takes place against the direction of transport. The dust-laden air is thereby sucked off towards the rear in the direction of travel and against the actual direction of the material transport, thus requiring a considerable additional expenditure for the equipment of the machine and a distinctly higher ventilator output. The particles separated by means of the ventilator and a downstream cyclone are dropped on the ground surface, thereby contaminating again the ground surface just milled. The cyclone dust separator provided at the rear end can separate only the coarser particles but not the respirable fine dusts, so that the arrangement of the air outlet at the rear end of the road milling machine is arranged too close to the operator's platform. In this way, the dusts and vapors are blown off at the rear end of the milling machine close to the operator's platform. In addition, the ventilator transports the dust-laden air so that high wear and tear leads to a short service life of the ventilator.

From DE 102 23 819 A1, it is therefore known to divide the channel formed by the hoods on the transport devices and to suck off the air polluted during milling in the direction of the material transport. This provides the advantage that the dusts and vapors are disposed of at a position located considerably farther away from the operator's platform and dust can only develop during the disposal onto the truck, where the development of dust is unavoidable anyway, and not additionally behind the road milling machine close to the operator's platform.

According to the prior art, the suction device shows an axial-flow fan arranged in a suction channel which, due to the high exposure to dusts and sharp-edged particles, is subject to heavy wear and tear, which ultimately leads to a reduced air output and the development of bearing damages. The fan blades of the axial-flow fan are heavily worn and damaged due to the impact and the deflection of the particles being conveyed at high speed. When larger particles and smaller stones are sucked in, other parts of the ventilator are also damaged mechanically, which in case of a damage to the fan blades frequently results in the occurrence of unbalances leading to bearing damages in continued operation. In case of repair, it is of disadvantage that the ventilator is arranged at a position which is difficult to access and a repair therefore leads to a major break in operation. Finally, due to the transport of the dusts and the sharp-edged particles, the ventilator must be designed in such a way that the clearance between the fan blades and the walls of the ventilator is larger so that the air output and the efficiency of such a ventilator for dust-laden and particle-laden air is lower.

A further disadvantage is that although the dusts are blown off at a distant position in relation to the operator's platform, they are still blown off into the environment so that a pollution of the workplace with dusts and vapors in the vicinity of the operator's platform, even if reduced, still exists.

Starting from this prior art, the task of the invention consists in creating a milling machine of the aforementioned type, as well as a process to dispose of dusts and vapors by means of which dusts and vapors developing during the milling operation and during the transport operation, in particular the respirable dusts, can be sucked off and disposed of with little mechanical expenditure and with higher effectiveness, and the service life of the suction device can be extended considerably at the same time.

SUMMARY OF THE INVENTION

The invention provides in an advantageous manner that the suction device consists of a suction ventilator, a separator device for solids and a suction channel connected to the rear channel section in the direction of the material transport, that the suction ventilator is arranged downstream of the separator device, and that the separator device disposes of the separated solids either onto the transport device in a forward channel section in the direction of the material transport or into a collecting device and blows off the cleaned air into the open.

The invention enables a simple design which does not require the setup of a road milling machine to be basically modified, so that existing road milling machines can also be retrofitted. Given that the suction ventilator of the suction device is arranged behind the separator device, the suction ventilator is operated on the pure-air side, so that the suction ventilator has a longer service life. The invention enables not only a significantly longer service life of the suction ventilator, but also a significant improvement of the air quality in the vicinity of the operator's platform. The pure air is blown off directly into the open. By separating the solids by means of the separator device, the percentage of respirable dusts is reduced to a considerable extent, so that the workplace conditions are considerably improved. The separated solids can be disposed of either onto the transport device in the forward channel section or into a collecting device.

Such a collecting device can, for example, consist of an air-permeable dust bag which can be removed during breaks in operation of the road milling machine in order to dispose of the separated solids.

It is preferably provided that the separator device consists of a filtering device and that the filter cake forming in the filtering device can be disposed of onto the transport device in the forward channel section or into the collecting device. The use of a filtering device has the advantage that it provides a high efficiency with regard to the respirable dusts and that the separated solids can be compacted to a filter cake which can be disposed of more easily without dusts being able to develop again to a considerable extent during the disposal. In principle, it is also possible to compact the filter cake even further with binding agents, for instance, a hydrous mist so that no dusts at all can develop during the disposal.

The filter cake can be removed automatically by the filtering device in predetermined time intervals or at a predetermined drop in pressure. It is also possible to clean the filtering device during breaks in operation only, for example, when replacing cutting tools, provided that the filter capacity is dimensioned accordingly. A further opportunity to remove the filter cake from the filtering device arises at each exchange of the truck traveling in front of the road milling and the short break in operation associated therewith.

For cleaning purposes, the filtering device is then charged with, for example, a vibration or a pulsed counter pressure.

One preferred embodiment provides that the forward channel section is separated from the rear channel section by means of separating media in order to largely block any air current without impeding the transport of the milled material. By separating the channel into a forward and a rear channel section, it is ensured that the dust-laden air, which is sucked off via the suction channel in the direction of the material transport, is sucked off from the rear dust-laden channel section only and that no air current can arise in the forward channel section against the direction of the material transport. The division is effected by means of separating media which, on the one hand, do not impede the transport of the milled material and, on the other hand, prevent an air current against the direction of the material transport.

It is preferably intended that the transport device shows at least one transport conveyor with a conveyor belt and that sealing media for the channel consist of hoods sealing against the conveyor belt and against the housing of the transport conveyor. Together with the conveyor belt and together with the housing of the transport conveyor respectively, the hoods thus form an enclosed channel so that the milled material passes through the transport device entirely enclosed in its circumference. In this way, no dusts or vapors can escape along the channel to the outside. Minor gaps in the course of the channel are irrelevant, because the channel is under negative pressure so that polluted air cannot escape at possible leaks but, at the most, air is sucked in.

A second forward transport device can accept the milled material at a transfer point at the end of the first rear transport device. The transfer point between the first and the second transport device is sealed in its circumference by means of flexible sealing media which are fastened to at least one of the transport devices. In this manner, a continuous channel is formed which includes both transport devices.

The separating medium can consist of a flexible flap which seals the rear channel section of the transport device against any entry of air against the direction of the material transport. In doing so, the negative pressure in the rear channel section reinforces the sealing by sucking the flap onto the conveyor belt.

In the following, embodiments of the invention are explained in more detail with reference to the drawings:

With the above and other objects in view that will hereinafter appear, the nature of the invention will be more clearly understood by reference to the following detailed description, the appended claims and the several views illustrated in the accompanying drawings.

DETAILED DESCRIPTION OF THE PREFERRED EMBODIMENTS

Figure 1:
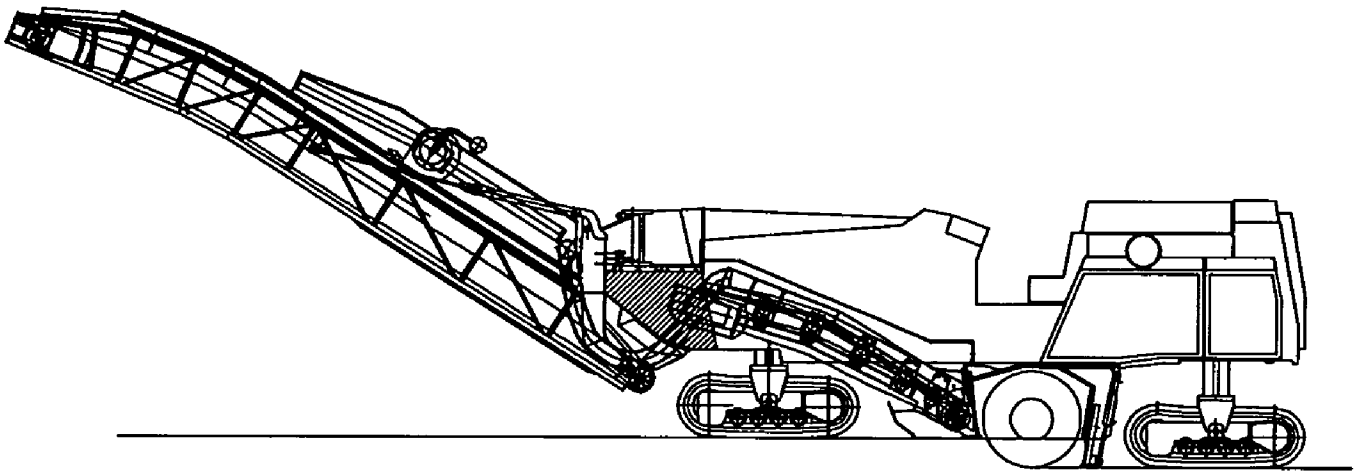
FIG. 1 shows a first embodiment of the invention in a front-loading road milling machine.

A road milling machine 1 to work pavements is shown in FIG. 1 in the embodiment of a front-loading road milling machine. It is understood that the invention is also applicable to different milling machines that are provided with at least one transport device 14, 18.

The road milling machine 1 serves to mill off ground surfaces, in particular pavements made of asphalt, concrete or the like. The road milling machine 1 shows a chassis with, for example, four crawler track units 4 which carries the machine frame 2. It is understood that the crawler track units may be substituted wholly or in part by wheeled units. A milling drum 8, which extends transversely to the direction of travel, is supported in the machine frame 2. The milling depth is preferably set by means of the height adjustment of the crawler track units 4. The road milling machine 1 depicted in FIG. 1 is also referred to as front-loading road milling machine, since it conveys the milled material to the front in the direction of travel onto a transport vehicle 10. In front of the milling drum 8 in the direction of travel, a first transport device 14 consisting of a transport conveyor with a conveyor belt 15 is arranged in a duct 9 of the machine frame 2, which runs in the machine frame 2 at an inclination. The first transport device 14 transports the milled material 3 on the conveyor belt 15 to a second transport device 18 which preferably also shows a conveyor belt 19. The second transport device 18 is adjustable in height by means of an adjustable inclination and can additionally be slewed sideways by, for instance, ±30°, so that transport vehicles 10 standing next to the lane of the road milling machine can also be loaded. Alternatively to the conveyor belts 15, 19, the use of conveyor augers arranged in a duct is also possible.

To achieve the completest possible transport of the milled material, the milling drum 8 is generally enclosed by a drum housing 58, the wall of which pointing in the direction of travel is designed as a blade 52 with an opening 56 for the milled material.

The milling drum 8 is provided with cutting tools arranged in the shape of a helix, which are arranged in such a manner that the milled material 3 is transported to the opening 56 in the blade 52. At the rear end of the drum housing 58 in the direction of travel, a wall 60 of the drum housing 58 is provided, which closes off tightly with the milled ground surface and levels the milled ground surface so that no fragments of the milled material 3 remain on the milled ground surface. With its lower edge, the wall 60 is pressed against the ground surface hydraulically in order to achieve the best possible sealing.

At the machine frame 2, a conveyor protection and support device referred to as conveyor shoe 50 is fastened in a guide in a height-adjustable manner. The conveyor shoe 50 receives the rear end of the first transport device 14. The opening 56 of the drum housing 58 forms a first transfer point 5 at which the milled material is transferred by the milling drum 8 onto the first transport device 14.

In the embodiment of FIG. 1, the operator's platform is located above the milling drum 8, but as is usual with road milling machines, it can also be arranged in the rear or the forward area of the machine frame 2.

Figure 5:
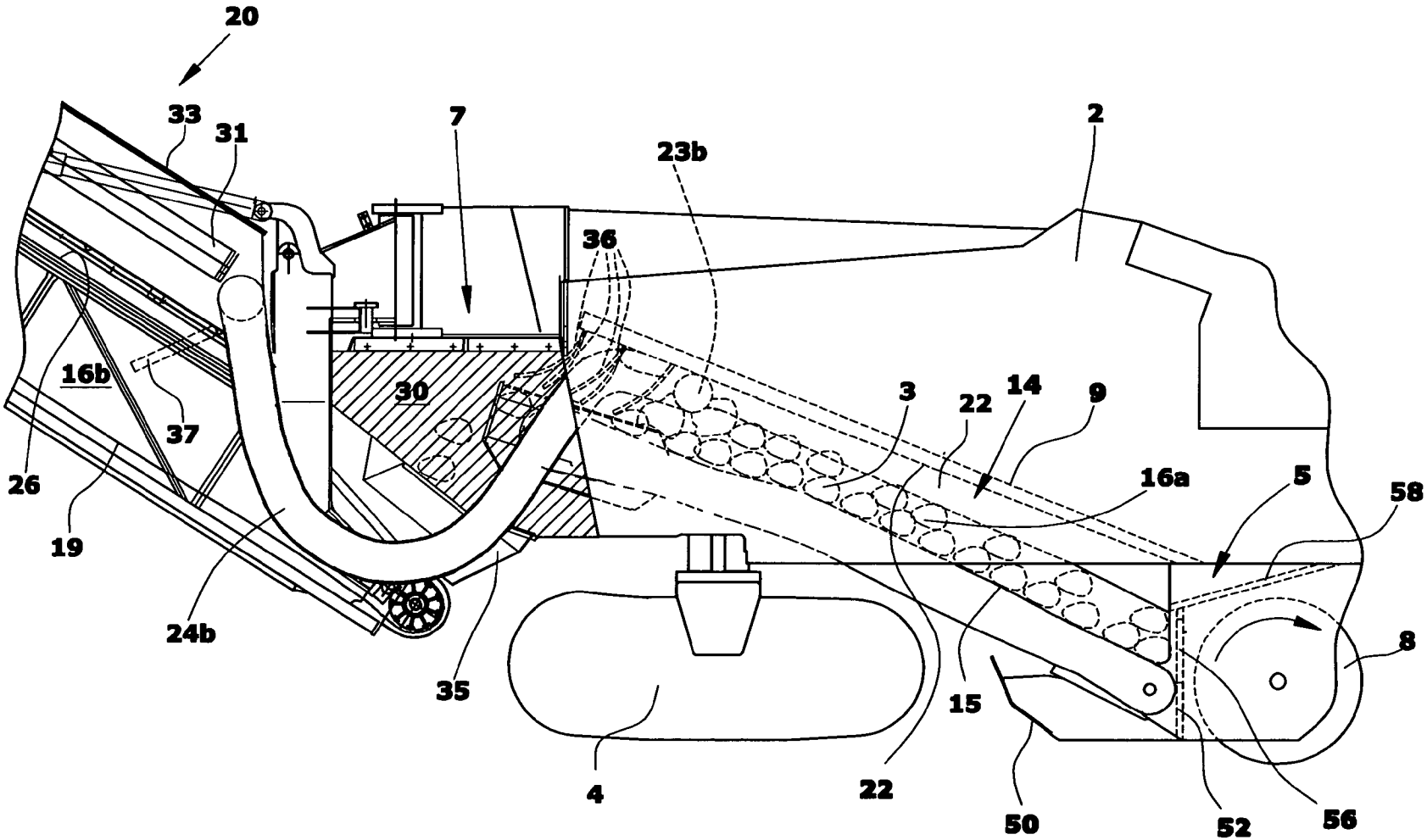
FIG. 5 is an enlarged illustration of a first embodiment of the suction device.
Figure 6:
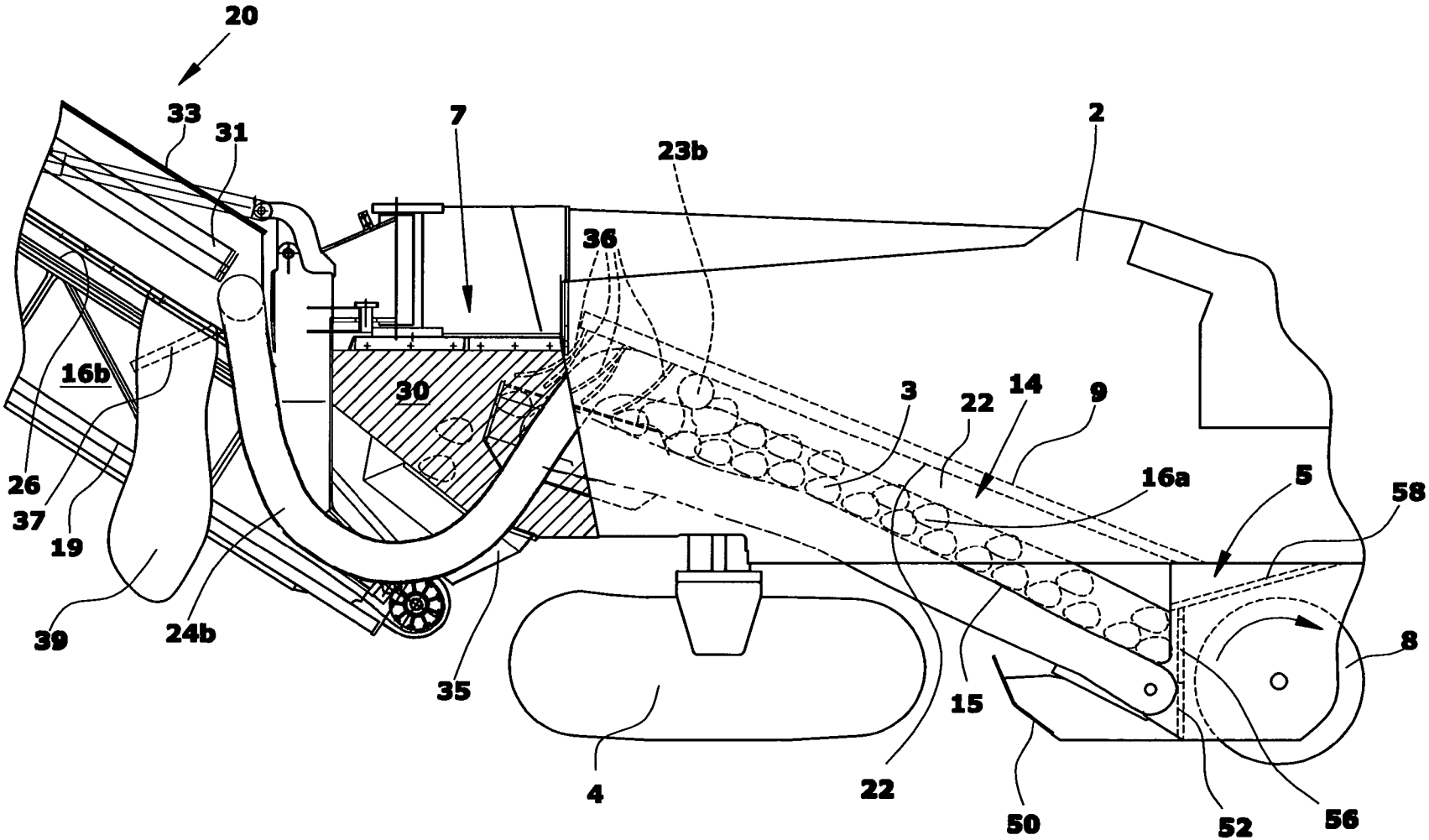
FIG. 6 is an enlarged illustration of a second embodiment of the suction device.

FIGS. 5 and 6 show in detail the first transport device 14.

The transport device 14 is fastened in a preferably centrally arranged duct 9 of the machine frame 2 and can easily be detached from the conveyor shoe 50 for maintenance purposes and be removed through the duct 9.

The transport device 14 with the conveyor belt 15 shows a hood 22 which, jointly with the carrying side 15*a* of the conveyor belt 15, forms a channel section 16*a* of a channel 16 which extends from the drum housing 58 to the end of the second transport device 18. As can be seen in detail in the cross section of FIG. 7, the hood 22 of the first transport device 14 is fastened to the frame of the first transport device 14 by means of hood supports 44. Elastic lips 46 can be fastened at the hood supports 44 on both sides of the transport conveyor and can touch the carrying side 15*a* of the conveyor belt 15 in the peripheral area over the entire length of the carrying side 15*a*.

In the same way, the second transport device 18 can also be provided with a hood 26. In this way, the entire channel 16 can be sealed off dust-proof and gas-proof against the environment, even though the sealing of the forward channel section 16*b* is actually only required in case a perceptible development of dust in the forward channel section 16*b* is detectable at all.

In the upper area of the hood 22 close to the discharge end but at a distance to the discharge end, the hood 22 of the first transport device 14 shows at least one connection 23, 23*a*, 23*b* to which at least one suction channel 24 can be connected. In the embodiment of FIG. 1, the suction channel 24 is formed by two suction hoses 24*a*, 24*b* which lead from the connections 23*a*, 23*b* to the inlet side of a filter housing of a filtering device 25, which is preferably fastened on top of the hood 26 of the forward transport device 18 in the area of the forward channel section 16*b*. The filtering device 25 preferably consists of several, for instance, ten filter cartridges 31 which are preferably paralleled to form one large filter surface. The suction ventilator 28 is arranged on the outlet side, i.e. on the pure-air side, and is thus charged with pure air only. Because the suction ventilator 28 is operated behind the filtering device 25, bearing damages and damages to the fan blades and additional ventilator elements are prevented in an advantageous manner, and in comparison to the prior art, a considerably longer service life of the suction device 20 is achieved. Because a filter cake can form in the filtering device 25, it is further possible to not only remove the vapors developing during the milling operation from the area of the operator's platform, but to bind them within the filter cake forming in the filtering device 25. As a result, not only the dust load but also the pollution of the respirable air with vapors is reduced to a considerable extent by the suction device 20, so that the workplace conditions can be improved to a considerable extent. An exhaust air connection 29 allows the cleaned exhaust air to be blown off directly into the open. Alternatively, the pure air can be blown off at the forward end of the filtering device 25 or at the forward end of the forward transport device 18. The suction ventilator 28 enables a high ventilator output, thus generating a correspondingly high negative pressure in the rear channel section 16*a* and in the drum housing 58 enclosing the milling drum 8. The dusts and vapors developing during the milling operation are, therefore, sucked off reliably and with high efficiency via the suction channel 24, 24*a*, 24*b*.

Figure 4:
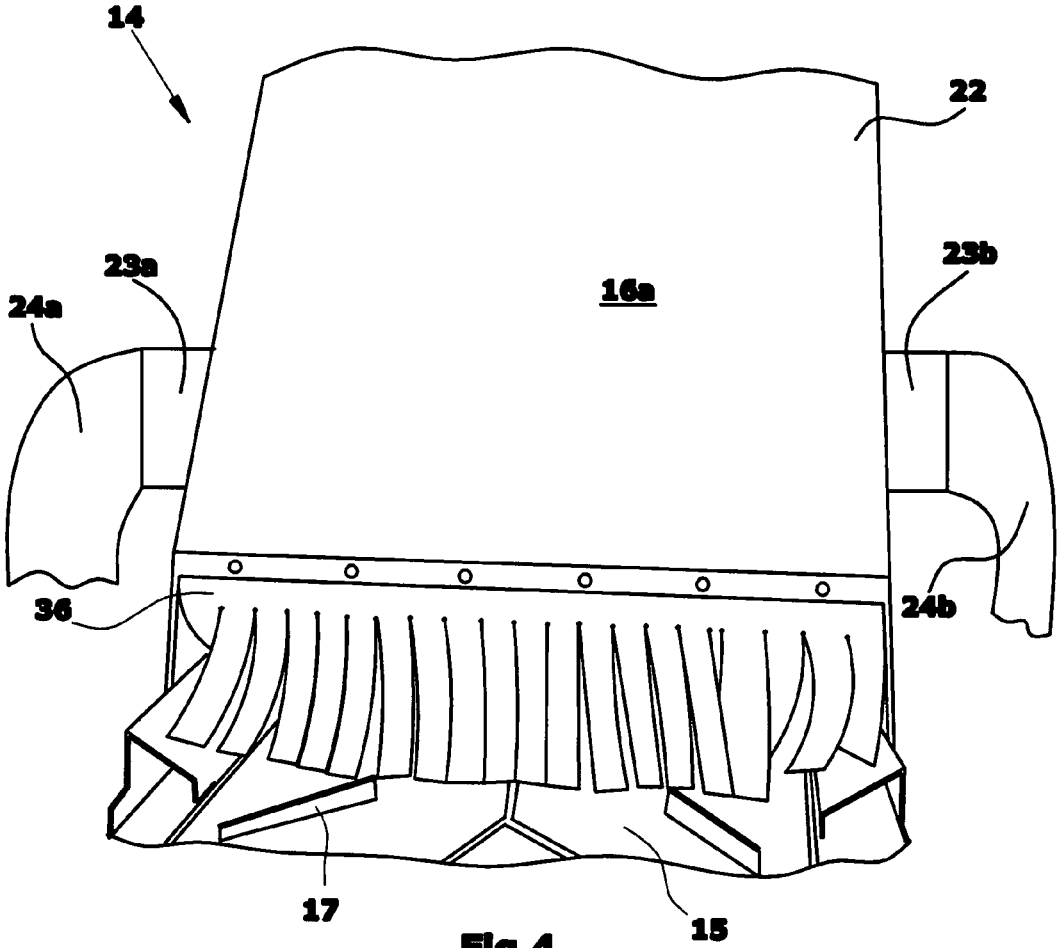
FIG. 4 is a view on the forward frontal end of the rear transport conveyor.

In the area of the first transfer point 5, i.e. at the lower end of the hood 22 and at the opening 56 of the drum housing 58 or the conveyor shoe 50 respectively, flexible rubber mats can seal off the transfer point 5 in its circumference. Minor leaks of the drum housing 58 or between the channel 16 and the drum housing 58 respectively are irrelevant, because due to the negative pressure no polluted air can escape but, at the most, air from the environment is sucked in. As can best be seen from FIG. 4, flexible flaps 36 are provided as separating media between the first and the second channel section 16*a*, 16*b* at the upper end of the hood 22 which, on the one hand, allow the milled material 3 on the conveyor belt 15 to pass and, on the other hand, prevent an air current against the transport direction of the first transport device 14. If only a single transport conveyor is provided, the separating media are, for example, positioned in the middle of the single transport device.

In order to seal the rear channel section 16*a* in the best possible way at its upper end, the flaps 36 are provided with slits. Several flaps 36 are preferably arranged behind one another to achieve an improved air sealing between the channel sections 16*a*, 16*b* (FIG. 5).

It is understood that the separating media inside the channel 16, which preferably consist of flaps 36, can also be arranged at a different position, for example, behind the second transfer point 7 in the direction of the material transport in the area of the second transport device 18. In this case, the suction channels 24*a*, 24*b* of the suction device 20 are connected to the hood 26 of the second transport device 18 upstream of the separating media in the direction of the material transport, preferably close to the separating media. The rear channel section 16*a* thus ends at the separating media which are arranged downstream of the transfer point 7 in the direction of the material transport.

Figure 7:
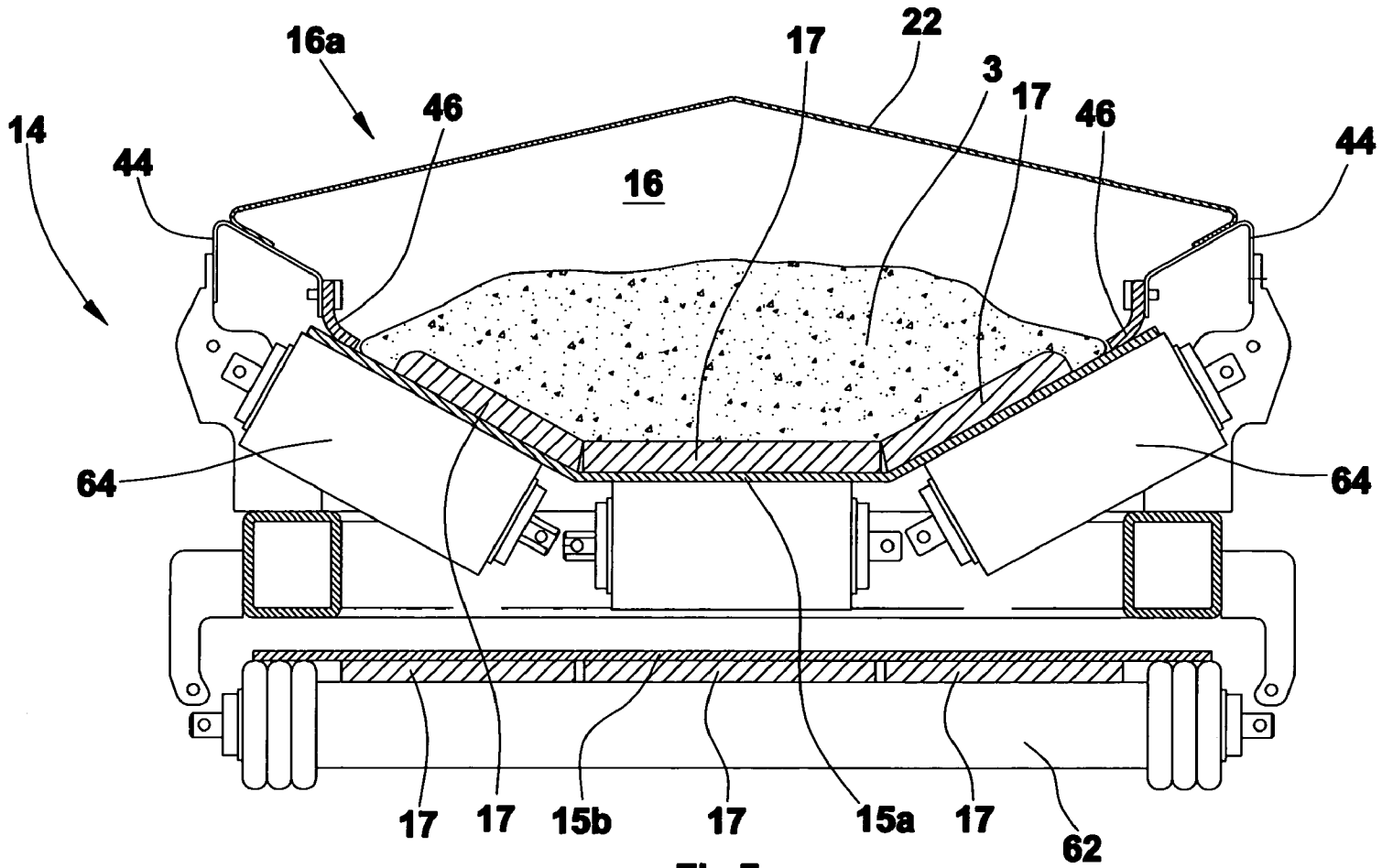
FIG. 7 is a cross section of the transport device.

As can best be seen from FIG. 7, the conveyor belt 15 is guided via support rollers 62, 64, whereby the carrying side 15*a* forms an essentially U-shaped trough in that the support rollers 64 are tilted correspondingly. The lower support roller 62 supports the return side 15*b* of the conveyor belt 15. As can be seen from FIGS. 3 and 4, ribs 17 are provided on the surface of the conveyor belt 15 which improve the conveyance of the milled material 3 on the conveyor belt 15.

At the upper end of the transport device 14, the milled material 3 is transferred into a receiving bin 35 of the second transport device 18 at the second transfer point 7, whereby the milled material 3 is conveyed to the discharge end via the conveyor belt 19 and disposed of onto the transport vehicle 10. The filter cake of the filtering device 25 can, for example, also be disposed of into this receiving bin 35 via a flap 37 in the filter housing 33 (FIG. 5). Alternatively, the filter cake can be filled into a collecting device 39 consisting of a dust-collecting bag (FIG. 6) which is fastened to an opening of the filter housing 33. With this embodiment, a flap 37 in the bottom of the filter housing 33 can also be provided as and when required.

The transition point at the transfer point 7 is enclosed by sealing media consisting of flexible mats 30 so that the first transport device 14 and the second transport device 18 form a channel 16 which is continuous in the direction of the material transport and sealed in its circumference.

Figure 2:
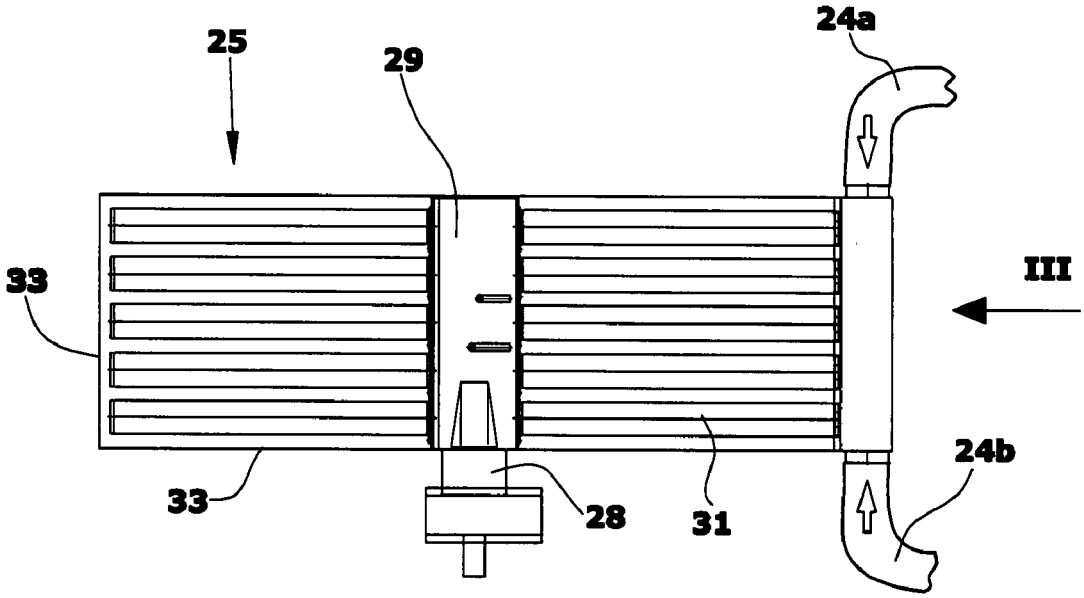
FIG. 2 is a top view of the filtering device resting on the forward transport device.
Figure 3:
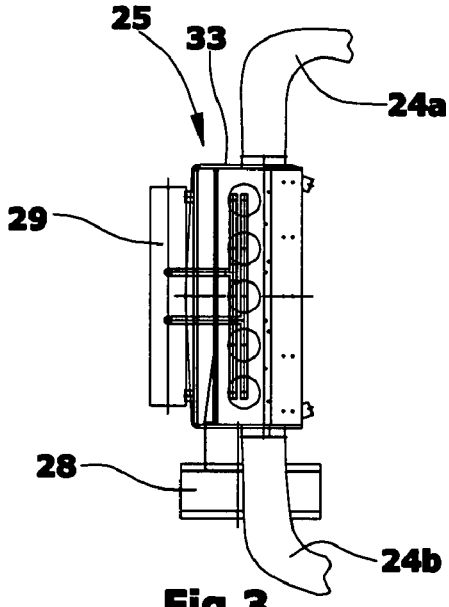
FIG. 3 is a view of the filtering device on the rear frontal end.

The filtering device 25 illustrated in FIGS. 2 and 3, which consists of several filter cartridges 31, is cleaned in time intervals which can be selected by the operating personnel, for example, during breaks in operation, such as the exchange of the truck 10 traveling ahead or the replacement of cutting tools, upon manual command, for example, by vibration or by charge with a pressure impulse, in counter flow direction. In doing so, the filter cake sitting on the filter cartridges 31 is removed. The filter cake can, of course, also be cleaned automatically depending on the drop in pressure developing with the prolonged operating period of the filtering device 25 or after predetermined time intervals. Due to the inclination of the bottom of the filter housing 33, the filter cake removed from the filter cartridges 31 can slide to the rear end of the filter housing 33 where it can, for example, be disposed of via a flap 37 and the receiving bin 35 onto the forward transport device 18. In doing so, it is also possible to additionally compact the filter cake by means of a spray and to increase the cohesion of the separated particles by the spray. The filter cake is placed onto the forward transport device 18 behind the separating media in an advantageous manner.

As can be seen from FIG. 2, the suction hoses 24*a*, 24*b* of the suction channel 24 enter the filter housing 33 from two opposite sides. Thereby, the filter cartridges 31 are charged from the outside with the dust-laden and vapor-laden air.

Although a preferred embodiment of the invention has been specifically illustrated and described herein, it is to be understood that minor variations may be made in the apparatus without departing from the spirit and scope of the invention, as defined by the appended claims.

What is claimed is:

1. A milling machine comprising a machine frame (2), a milling drum (8) and an operator's platform supported by the machine frame (2), at least one transport device (14, 18) having a loading end and a discharging end opposite each other, the loading end of said transport device (14) being located adjacent said milling drum (8) for receiving milled material (3) from the milling drum (8), means (9, 22, respectively) for enclosing said at least one transport device and defining respective first and second channel sections (l6*a*, 16*b*, respectively) thereof, suction means (20) in fluid communication with the first channel section (16*a*) of the transport device (14) for withdrawing air polluted with entrained respirable dust and vapors, said suction means (20) including a suction ventilator (28) and a filtering device (25), at least one suction channel (24*a*, 24*b*) connected between said filtering device (25) and the first channel section (16*a*) of the transport device (14), said filtering device (25) including means for creating filter cakes from the entrained respirable dust and vapors, said filtering device (25) being located between said at least one suction channel (24*a*, 24*b*) and said suction ventilator (28) whereby polluted air from the at least one suction channel (24*a*, 24*b*) is first drawn through said filtering device (25) and only thereafter through said suction ventilator (28) and filter cakes formed by said filter device (25) are deposited upon the second channel section (16*b*) of said transport device, and said suction ventilator (28) including a clean air exhaust (29) for blowing air cleansed of respirable dust and vapors into the environment thereby substantially reducing air pollution, and means (36) at an end of said first channel section (16*a*) adjacent an entry point of said at least one suction channel (24*a*, 24*b*) into said first channel (16*a*) for blocking air flow from said second channel section (16*b*) beyond said entry point.

2. The milling machine as defined in claim 1 including means for vibrating the filtering device (25) for cleaning purposes.

3. The milling machine as defined in claim 1 including means for applying pulsed counter air pressure to the filtering device (25) for cleaning purposes.

4. The milling machine as defined in claim 1 wherein said at least one at least one transport device (14, 18) is defined by at least one conveyor belt (15, 19), and at least one of said first and second channel sections (16*a*, 16*b*) is formed by at least one hood (22, 26) in sealing relationship against said at least one conveyor belt (15, 19) and against a housing of said at least one transport device (14, 18).

5. The milling machine as defined in claim 4 including means (44) for fastening the at least one hood (22, 26) with respect to the at least one transport device (14, 18), and said last-mentioned means includes an elastic sealing lip between said at least one transport device (14, 18) hood (22, 26) and said at least one conveyor belt (15, 19).

6. The milling machine as defined in claim 1 wherein the discharging end of the at least one transport device (14) defines a transfer point (7) for filter cakes, and sealing means (30 ) for flexibly circumferentially sealing the first and second channel sections (16*a*, 16*b*) relative to each other at said transfer point (7).

7. The milling machine as defined in claim 1 wherein said air blocking means (36) is defined by at least one flexible flap (36) extending entirely across an opening of the first channel section (16*a*) at a discharging end thereof.

* * * * *